US006550380B2

(12) United States Patent
Kinoshita et al.

(10) Patent No.: US 6,550,380 B2
(45) Date of Patent: Apr. 22, 2003

(54) METHOD FOR STENCIL PLATE MAKING OF STENCIL SHEET FOR STENCIL PRINTING

(75) Inventors: Hideyuki Kinoshita, Ibaraki-ken (JP); Yasuo Yamamoto, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/968,664

(22) Filed: Oct. 2, 2001

(65) Prior Publication Data

US 2002/0040647 A1 Apr. 11, 2002

(30) Foreign Application Priority Data

Oct. 3, 2000 (JP) ..... 2000-304072
Oct. 31, 2000 (JP) ..... 2000-333717

(51) Int. Cl.[7] ..... B41C 1/14; B41J 2/32

(52) U.S. Cl. ..... 101/128.4; 101/128.21; 400/120.01; 400/120.09; 347/171; 347/188

(58) Field of Search ..... 101/127, 128.21, 101/128.4, 129; 347/171, 206, 193, 188; 400/120.01, 120.12, 120.13, 120.09

(56) References Cited

U.S. PATENT DOCUMENTS 5,216,951 A * 6/1993 Yokoyama et al. ..... 101/128.4
5,417,156 A * 5/1995 Tateishi et al. ..... 101/128.21

* cited by examiner

*Primary Examiner*—Leslie J. Evanisko
(74) *Attorney, Agent, or Firm*—Gary M. Nath; Harold L. Novick; Marvin C. Berkowitz

(57) ABSTRACT

A micro porous plastic sheet is stencil plate made by a method for stencil plate making of a stencil sheet for stencil printing under the following conditions: heat is provided to form a negative image with TPH at $-30 \leqq Tp-Tm \leqq 300°$ C. (Tp is heating peak temperature and Tm is melting temperature (melting point) of the sheet) and in $10 \leqq To \times 100/Ts \leqq 80\%$ (To is current-carrying time period and Ts is current-carrying cycle), micro pores are closed by the pressure for stencil plate making of $0.1 \leqq P \leqq 1.0$ MPa, and the thermal shrinkage rate of the sheet measured by TMA is set to $1 \leqq S_{Tm-30} \leqq 20\%$ ($S_{Tm-30}$ is a thermal shrinking rate of the sheet at a temperature 30° C. lower than the melting point TM).

4 Claims, 3 Drawing Sheets

METHOD FOR STENCIL PLATE MAKING OF STENCIL SHEET FOR STENCIL PRINTING

BACKGROUND OF THE INVENTION

1. Field of the Invention

The present invention relates to a method for stencil plate making of a stencil sheet for stencil printing. More particularly, it relates to a method for stencil plate making of a stencil sheet for stencil printing using a micro porous plastic sheet as a stencil sheet for stencil printing and wherein the micro pores of the plastic sheet are closed by a thermal print head (referred to as TPH hereinafter).

2. Description of the Prior Art

Conventionally, as a sheet (stencil sheet) for stencil printing, a heat-sensitive sheet perforated by infrared radiation or TPH has been known. A sheet made of a thermoplastic film and a porous tissue paper stuck together by adhesive is used in general.

Further, rotary-type and simple press-type are known as a stencil plate printing machine using a heat-sensitive stencil sheet.

These printing machines perform printing by pushing the ink from the tissue paper side of the stencil sheet through pores perforated in the film corresponding to a line area of a print image thereby transferring ink onto print paper.

In the conventional stencil printing system, an improvement in ink drying has been sought because it takes a long time for ink to permeate print paper.

Namely, there are problems such that ink hardly permeates the surface of print paper, making fingers stained upon touching a printed sheet right after printing. Another problem is that when printing with a second color and subsequent colors in multicolor printing or printing on the back of the printed surface of the paper continuously, the ink is transferred to a rubber roller of the printing machine, thereby making the printed sheet stained owing to the ink transferred. The problem causes another disadvantage that a long time (10 to 20 minutes, for example) is needed to move to a further step.

To solve the above problem for obtaining instant dryness, it is effective to enhance ink permeability for print paper using low viscosity ink, to facilitate drying.

However, even if low viscosity ink is used in case that the amount of ink transferred is excessive, its drying worsens Therefore, in the conventional stencil plate printing system, when low viscosity ink is used, in order to suppress the amount of ink transferred, perforation diameter is required to be at least smaller than 20 $\mu$m.

However, when the perforation diameter is decreased as described above, heat element density (resolution) of TPH must be increased to make that a line are not fainted by increasing dot density to be perforated.

This would raise the cost of TPH as well as require level improvement in peripheral techniques such as securing of durability of TPH, yield improvement and increasing film sensitivity of a heatsensitive stencil sheet.

To solve the above problems, the present inventors have proposed a method for stencil plate making which comprising: preparing a stencil plate having a large number of continuous pores in the order of sub-micron (referred to as a micro porous sheet or a sheet hereinafter); and the pores corresponding to a non-line area are closed to obtain an ink impermeable area.

However, there is a problem that when making a stencil plate of a micro porous sheet in the aforementioned method, some pores without being closed (referred to as pinhole hereinafter) which are supposed to be closed by shrinking or melting a sheet, are produced in reality and that ink passes through the pinholes and transferred to printing paper.

A method for coating the surface of the sheet with a releasing agent is proposed to solve the problem. However, there is still a problem that some pinholes are produced even though the aforementioned method is used.

There is another problem that when the sheet is stencil plate made according to the above method, the sheet is shrunk with heat of TPH during stencil plate making, resulting in that the original dimension reproducibility is poor. Further, when the sheet is fed into the printing machine or attached to a printing drum, the sheet is wrinkled.

SUMMARY OF THE INVENTION

Namely, an object of the present invention is to provide a method for stencil plate making in which micro pores of a stencil sheet are closed by applying heat with TPH required for shrinking and melting the surface or up to the inside of the micro porous sheet, and wherein, no pinholes are produced; and excellent dimensional reproducibility of the sheet is obtainable.

To achieve the above object, the applicants have discovered the following conditions: driving conditions for TPH such as heating temperature, current-carrying time period and current-carrying cycle; a pressure condition (referred to as pressure condition for stencil plate making hereinafter) under which a sheet is pressed between TPH and its corresponding platen roller: and a thermal shrinkage condition of the sheet. These conditions allow producing no pinholes or very few pinholes on the sheet.

Further, the applicants have also discovered that when making a stencil plate, the rate of the thermal shrinkage of the micro porous sheet varies depending on TPH driving conditions, the stencil plate making pressure condition and the thermal shrinkage condition.

In other words, the method for stencil plate making of the present invention is characterized in that a stencil sheet is stencil plate made for a micro porous sheet by closing micro pores under the conditions which satisfies the following formulae at the same time.

<Driving Condition for TPH>

$$-30 \leqq Tp - Tm \leqq 300 \ (^\circ \text{C.}) \quad (1)$$

(wherein Tp represents a heating peak temperature of TPH, and Tm represents a melting temperature (melting point) of the sheet)

$$10 \leqq To \times 100/Ts \leqq 80 \ (\%) \quad (2)$$

(wherein To represents a current-carrying time period, Ts represents a current-carrying cycle, To×100/Ts represents the ratio of To to Ts)

<Pressure Condition for Stencil Plate Making>

$$0.1 \leqq P \leqq 1.0 \ (\text{MPa}) \quad (3)$$

(wherein P represents a pressure for stencil plate making)

<Thermal Shrinkage Condition>

$$1 \leqq S_{Tm-30} \leqq 20 \ (\%) \quad (4)$$

(wherein $S_{Tm-30}$ represents thermal shrinkage ratio at a temperature 30° C. lower than the melting point of the sheet Tm in TMA (thermal mechanical analysis)

Further, the applicants have discovered that a more preferable result can be obtained by controlling the distribution of heating temperature of TPH.

In other words, the present invention is characterized in that the ratio of the size and pitch of the heat element in the direction of main scanning and sub scanning satisfies the following formula (5) and (6). Provided that the direction of main scanning is the direction that heat element of TPH stand in line, and the direction of sub scanning is across the main scanning direction, that is, the direction stencil sheet is fed.

The present invention is characterized in that the ratio of the size of the heat element and the pitch of this heat element in the direction of the main scanning of the thermal print head is:

preferably $$42 \leqq MR_S/MR_P \leqq 88\ (\%) \tag{5}$$

and more preferably satisfied with $$54 \leqq MR_S/MR_P \leqq 88\ (\%)$$

and the ratio of the size of the heat element and the pitch of this heat element in the direction of the sub-scanning of the thermal print head is:

preferably $$42 \leqq SR_S/SR_P \leqq 519\ (\%) \tag{6}$$

and more preferably $$54 \leqq SR_S/SR_P \leqq 330\ (\%)$$

and furthermore preferably $$65 \leqq SR_S/SR_P \leqq 84\ (\%)$$

(wherein $MR_S$ is the size of the heat element In the direction of main scanning and $MR_P$ is the pitch (length) of the heat element in the direction of main scanning of the thermal print head, $SR_S$ is the size of the heat element in the direction of sub-scanning and $SR_P$ is the pitch (length) of the heat element in the direction of sub-scanning of the thermal print head.)

In the case of a thick film type thermal print head, "the size of the heat element in the direction of main scanning" is "the length between electrodes adjacent to each other", and further, "the pitch (length) of the heat element" is "the pitch (length) of the electrodes".

It should be noted that the type of the thermal print head may be a line type of a thermal print head or a serial type of a thermal print head in the present invention. Moreover, the resistor of the thermal print head may be a thin film type thermal print head formed mainly by sputtering or a thick film type thermal print head formed by the method for thick film printing.

A mechanism for closing micro pores by heating in the present invention will be described hereinafter.

A micro porous plastic sheet thermally shrinks in its dimension from a lower temperature lower than the melting point of the sheet by heat generation of the heat element of TPH to release a residual stress caused by extension received during the time of making a film. At this event, although the micro pores are closed by the thermal shrinking, they are not completely closed when the thermal shrinking is not enough. As the temperature rises to reach the melting point of the sheet, the surface or up to the inside of the plastic sheet melts and then the multiple micro pores are completely closed, resulting in yielding complete blockage areas (non-line area). However, even if the temperature does not reach the melting point, and if the heat shrinking of the sheet is enough, at least micro pores on the face of the stencil sheet in contact with TPH are completely closed.

Making a stencil of the present invention is performed by nipping the sheet during applying pressure with TPH and a platen roller associated with TPH and driving the sheet. In other words, the sheet is maintained in a state of tension in which the thermal shrinkage is suppressed all the time by applying pressure. In this state, the sheet receives a shearing stress toward the sheet feeding direction of the plane by the pressure applied and the feeding the sheet. While the sheet before melting which begins shrinking or the sheet which has melted after the temperature reached its melting point, maintains its dimension accuracy to some extent because the sheet is nipped by using TPH and a plate roll. Moreover, the micro pores are stroked and closed by the shearing stress. Namely, the degree of blockage of the micro pores depends on the shearing stress, that is, the pressure condition for stencil plate making.

More particularly, the tensional state to suppress the thermal shrinkage of the sheet varies depending on the pressure condition for stencil plate making, resulting in that the thermal shrinkage of the sheet by making a stencil plate depends on the pressure condition for stencil plate making.

To be more precise, the degree of blockage of micro pores and the degree of thermal shrinkage of a sheet by making a stencil plate depend on the driving conditions for TPH such as heating temperature, current-carrying time period and current-carrying cycle of TPH, a pressure condition for stencil plate making, and a condition for thermal shrinkage.

Further, the degree of blockage of micro pores and the degree of thermal shrinkage of the sheet also depend on the distribution of heating temperature of the thermal print head (or the distribution of heating temperature on a micro porous sheet).

One of the factors for controlling the distribution of heating temperature of the thermal print head concerning the direction of main scanning of the thermal print head is "the ratio of the size of the heat element in the direction of main scanning to the pitch in the direction of main scanning of a heat element". The distribution of heating temperature on the micro porous sheet depends on its ratio.

Further, concerning the direction of sub-scanning of the thermal print head, resolution (pitch) of element can be arbitrarily set by adjusting a feeding speed for a micro porous sheet (a stencil sheet) and the driving condition for the TPH such as current-carrying cycle. The distribution of heating temperature on a micro porous sheet varies depending on "the ratio of the size of the heat element in the direction of sub-scanning for the pitch (length) to the heat element in the direction of sub-scanning".

According to the method for stencil plate making of a stencil sheet for stencil printing of the present invention, excellent blockage of pores is achieved, and no pinholes or very few pinholes are produced. Moreover, the method can provide a stencil sheet with suppressed thermal shrinkage when making a stencil for stencil printing.

In addition to that, when stencil printing is performed by applying ink with low viscosity to a stencil plate according to the method for stencil plate making of the present invention, a printed matter with excellent image quality and instant drying is can be obtained.

The present disclosure relates to subject matter contained in Japanese Patent Application No. 2000-304072, filed on Oct. 3, 2000 and Japanese Patent Application No. 2000-

333737, filed on Oct. 31, 2000, the disclosure of which is expressly incorporated herein by reference in its entirety.

DETAILED DESCRIPTION OF THE INVENTION

Figure 1:
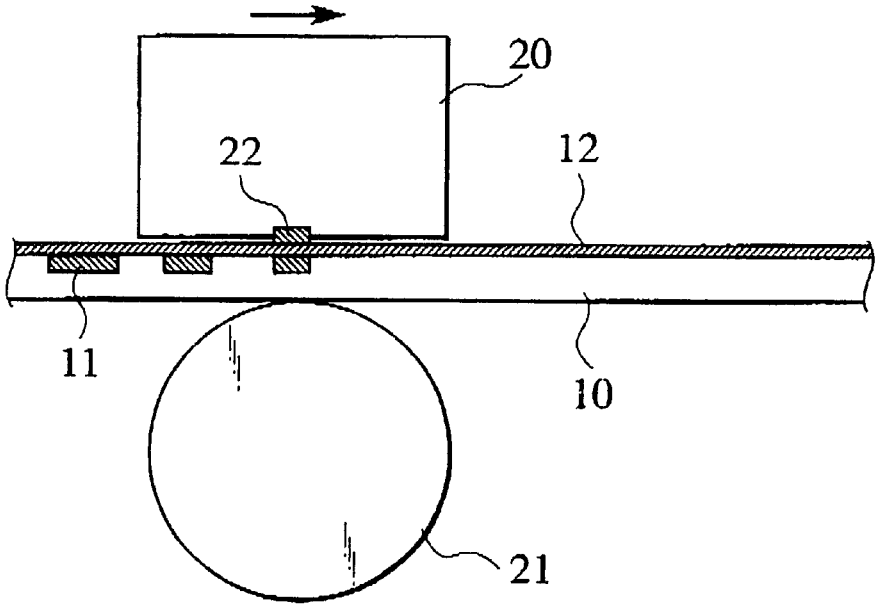
FIG. 1 schematically shows an embodiment of a stencil plate making unit used in the present invention.

The following describes a detailed embodiment of the present invention.

In the present invention it is preferable that driving conditions for TPH satisfies the following formulae (1) and (2);

$$-30 \leqq Tp-Tm \leqq 300 (^\circ \text{ C.}) \quad (1)$$

more preferably, $$-20 \leqq Tp-Tm \leqq 250 (^\circ \text{ C.})$$

furthermore preferably, $$0 \leqq Tp-Tm \leqq 200 (^\circ \text{ C.})$$

Wherein, Tp represents heating peak temperature of TPH, and Tm represents the melting temperature (melting point) of the sheet.

$$10 \leqq To \times 100/Ts \leqq 80 (\%) \quad (2)$$

more preferably, $$20 \leqq To \times 100/Ts \leqq 60 (\%)$$

furthermore preferably, $$25 \leqq To \times 100/Ts \leqq 50 (\%)$$

Wherein, To represents current-carrying time period, Ts represents current-carrying cycle, and To×100/Ts represents the ratio of To to Ts.

In formula (1), when Tp−Tm is under −30° C., the thermal shrinkage of the sheet is too small, so that the micro pores do not tend to be closed. When Tp−Tm is over 300° C., the thermal shrinkage is too large, so that there is a fear that the dimension accuracy of the sheet can not be maintained.

In formula (2), when To×100/Ts is under 10%, and even if the heating temperature is within the range of formula (1), thermal shrinking or melting of the sheet ends instantly, and then it takes a long time that the heat is not conducted to the sheet before the next current-carrying, so that it is worried that the micro pores cannot be closed. When To×100/Ts is over 80(%), and even If the heating temperature is within the range of formula (1), thermal shrinking or melting of the sheet is too extensive, so that it is worried that the dimension accuracy of the sheet can not maintained.

Further, the pressure condition for stencil plate making satisfies preferably with the following formulae in the present invention:

$$0.1 \leqq P \leqq 1.0 \text{ (MPa)} \quad (3)$$

more preferably, $$0.2 \leqq P \leqq 0.9 \text{ (MPa)}$$

furthermore preferably, $$0.3 \leqq P \leqq 0.8 \text{ (MPa)}$$

wherein P in the formulae represents pressure for stencil plate making.

In formula (3), when the pressure of stencil plate making is under 0.1 (MPa), shearing stress is small, so that it is worried that micro pores can not be closed, even if they are stroked. Further, the thermal shrinkage of the sheet can not be controlled because of a loose tensional state of the sheet. It is worried that the dimension accuracy of the sheet can not be maintained. In addition to that, when the pressure for stencil plate making is exceeds 1.0 (MPa). variations in feeding speed of the sheet are generated, which causes an extreme shrinkage partially and makes it difficult to maintain dimension accuracy of the sheet.

Furthermore, it is preferable in the present invention that the conditions for thermal shrinkage of the sheet satisfies the following formulae of $$1 \leqq S_{Tm-30} \leqq 20 (\%) \quad (4)$$

more preferably, $$3 \leqq S_{Tm-30} \leqq 15 (\%)$$

furthermore preferably, $$4 \leqq S_{Tm-30} \leqq 10 (\%)$$

$S_{Tm-30}$ in the above formulae represents thermal shrinkage ratio at a temperature 30° C. lower the melting point of the sheet Tm measured by TMA (thermal mechanical analysis).

When $S_{Tm-30}$ is under 1 (%), and even if heating temperature is within formula (1), no thermal shrinkage of the sheet is produced, which causes difficulty in blockage of micro pores. When $S_{Tm-30}$ is over 20%, thermal shrinkage is too large, which causes difficulty in maintaining the dimension accuracy of the sheet.

The present invention can preferably achieve the blockage of the micro pores by satisfying the above formulae (1) to (4) at the same time.

Figure 2:
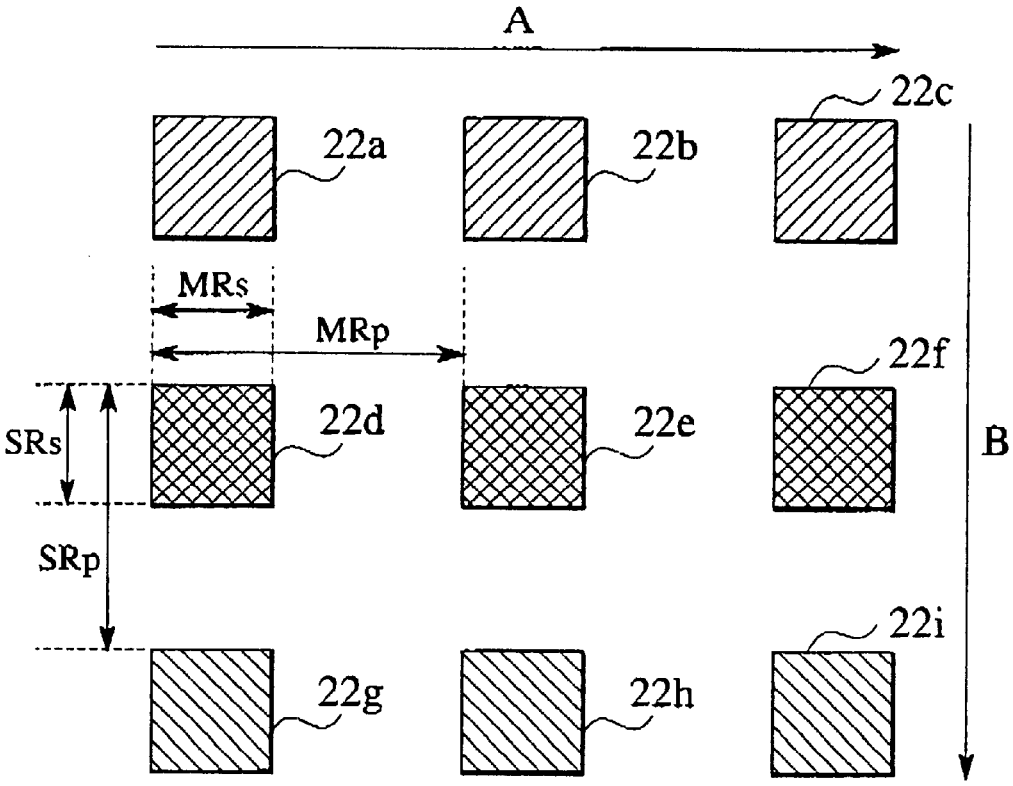
FIG. 2 schematically shows the sizes and the pitches of the heat element in the direction of main scanning and in the direction of sub-scanning of the thermal print head.

Further, it is also preferable to satisfy the following conditions in order to more effectively suppress producing pin holes and the thermal shrinking of the sheet. The following will be described with reference to FIGS. 1 and 2.

The Ratio ($MR_S/MR_P$) of the size ($MR_S$) of the heat element (22) to the pitch ($MR_P$) of this heat element (22*a*–22*i*) in the direction of main scanning (A) of the thermal print head (20) satisfies $$42 \geqq MR_S/MR_P \geqq 88 (\%) \quad (5)$$

Further, the ratio ($SR_S/SR_P$) of the size ($SR_S$) of the heat element (22) to the pitch ($SR_P$) of this heat element (22) in the direction of sub-scanning (B) of the thermal print head (20) satisfies $$42 \leqq SR_S/SR_P \leqq 519 (\%) \quad (6)$$

Where ($MR_S$) is the size of the heat element In the direction of main scanning of the thermal print head, ($MR_P$) is the pitch of the heat element in the direction of main scanning of a thermal print head, ($SR_S$) is the size of a heat element in the direction of sub-scanning of the thermal print head, and ($SR_P$) is the pitch of the heat element in the direction of sub-scanning of the thermal print head.

The thermal print head (20) may be a thermal print head (20) of a line type that heat elements stand in line which has a predetermined pitch in the direction of main scanning (A) or a thermal print head (20) of a serial type moving in a predetermined pitch to the direction of main scanning (20). The thermal print head (20) relatively moves in a predetermined pitch to the direction of sub-scanning (B) on the micro porous sheet (10) to form a blockage area (non-line) area (11) by closing the micro pores of the micro porous sheet (10) by heat generation of the heat element (22).

Figure 3A:
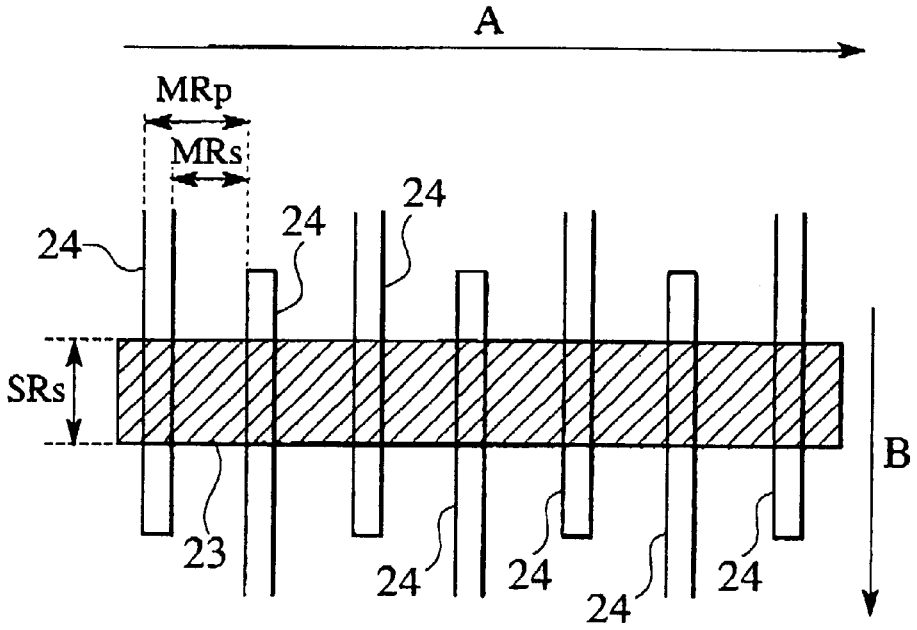
FIG. 3 schematically shows the sizes and the pitches of the heat element in the direction of main scanning and in the direction of sub-scanning of the thermal print head when the thermal print head having a thick film formed in the method for thick film printing is used.
Figure 3B:
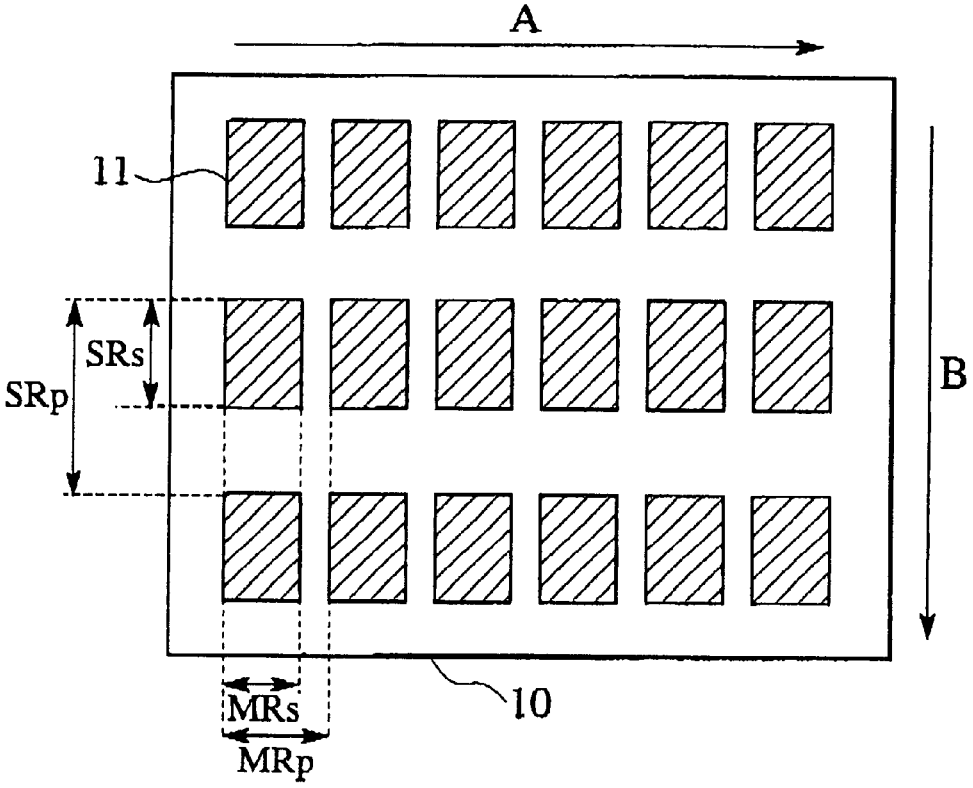

It should be noted that the resistor of the thermal print head (20) may be a thin film type thermal print head formed by mainly sputtering or a thick film type thermal print head (23) formed by the method for thick film printing as shown in FIG. 3(*a*). Wherein in case of a thermal print head having a thick film, "the size of a heat element in the direction of main scanning (A)" is "the length ($MR_S$) between adjacent electrodes (24)", and further, "the pitch of a heat element (22) in the direction of main scanning (A)" is "the pitch (MRP) (length) of an electrode (24)". It should also be noticed that FIG. 3(*b*) illustrates the size and pitch of the heat element in the direction of main and sub scanning of the thermal head in case that a thick film type thermal print head is employed.

Figure 4:
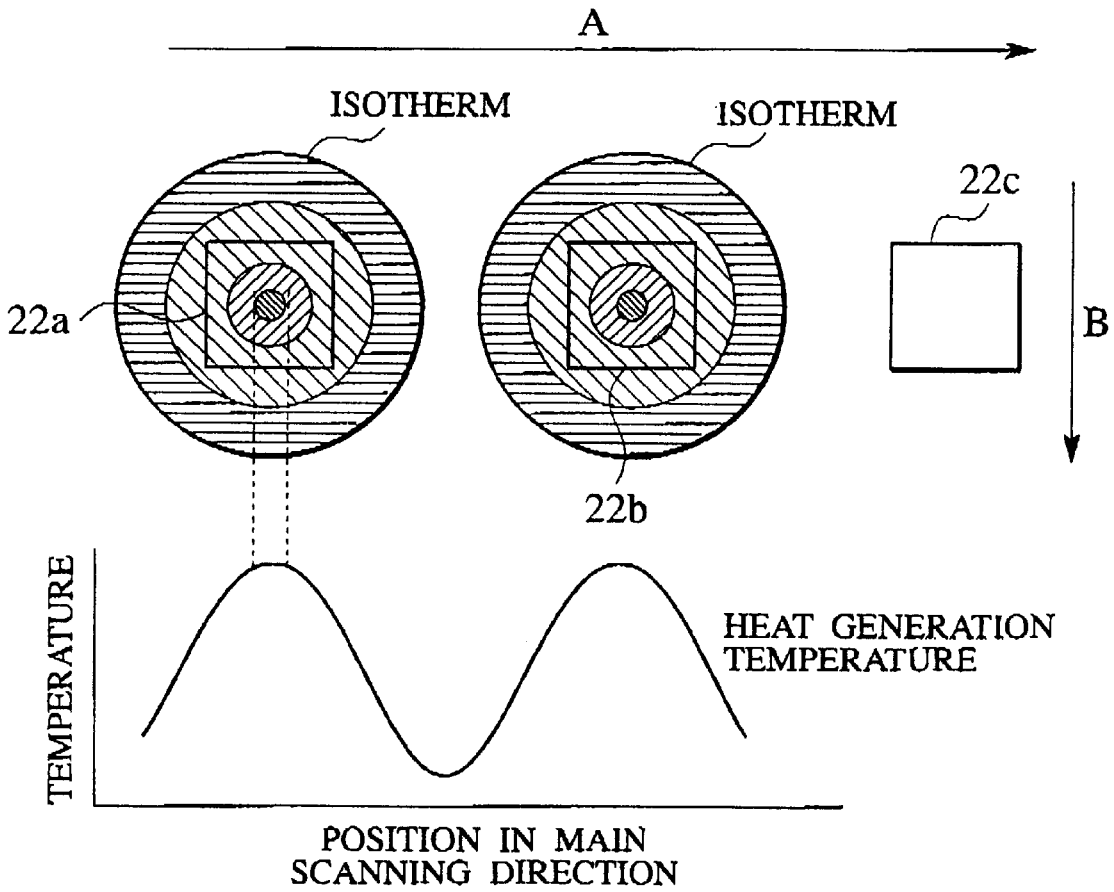
FIG. 4 shows an image illustrating the distribution of heating temperature of the thermal print head.

One of the factors for controlling the distribution of heating temperature of the thermal print head (20) concerning the direction of main scanning (A) of the thermal print head (20) is "the ratio ($MR_S/MR_P$) of the size of the heat element ($MR_S$) in the direction of main scanning to the pitch ($MR_P$) in the direction of main scanning (A) of the heat element". In other words, as shown in FIG. 4, temperature at the center of the heat element (22*a*) is highest, and it is gradually lowered from the center and lowest in the middle part of the adjacent elements.

Accordingly, in formula (5), when the ratio ($MR_S/MR_P$) is under 42%, the temperature in the middle part of the heat elements (22) of the thermal print heads (20) adjacent to each other is too low. For that reason, micro pores corresponding to that part are not closed, resulting in generating pinholes. Further, when the ratio ($MR_S/MR_P$) is over 88%, the temperature in the middle part of the heat element of adjacent thermal print heads is too high, resulting in that shrinkage by melting is too large to maintain the dimension accuracy of this sheet Concerning the direction of sub-scanning (B) of the thermal print head (20), resolution of heat element can be arbitrarily set by adjusting a feeding speed of the micro porous sheet or current-carrying cycle of driving conditions for the thermal print head (20) or the like. Thus, the distribution of heating temperature on the micro porous sheet (10) varies depending on the aforementioned "the ratio ($SR_S/SR_P$) of the size ($SR_S$) of the heat element (22) in the direction of sub-scanning to the pitch ($SR_P$) of the heat element (22) in the direction of sub-scanning (B)".

Hence, in formula (6), when the ratio ($SR_S/SR_P$) is under 42, the temperature between the pitches ($SR_P$) of the heat element (22) in the direction of sub-scanning (B) is too low, which causes no blockage of micro pores corresponding to the areas, resulting in producing pinholes. Further, when the ratio ($SR_S/SR_P$) is over 519, the temperature between the pitches of heat generating dots in the direction of sub-scanning is too high, which causes difficulty in maintaining dimension accuracy of this sheet.

The micro porous sheet used in the present invention is not particularly specified. However, thermoplastic resin is mainly used preferably because it is possible to make a stencil by thermal melting. Specifically, polyester such as polyethylene terephthalate, polybutylene terephthalate; polyamide such as 66 nylon, nylon 12; a kind of chlorinated resin such as polyvinyl chloride, polyvynilidene chloride or their copolymer; fluororesin such as polytetrafluoroethylene, tetrafluoroethylene-ethylene copolymer; polyolefin or the like is presented as thermoplastic resin. Especially, polyolefin, more particularly polyethylene is preferably used among them. These resins can be used alone or in combination of more than two to form a multiple-layered structure.

As one example of polyethylene preferably used for a micro porous sheet for the present invention is polyethylene for a micro porous polyethylene film having multiple micro pores which was disclosed in Japanese Patent Application Laid Open (Japanese Patent Republication No.11-130900), applied by Asahi Kasei Corporation Co., Ltd. on Oct. 27th in 1997. In other words, various polyethylene polymer alone having from high to low density or copolymer (linear polyethylene copolymer) with α-olefin-containing propylene, butene. pentene, hexene, octene and the like can be preferably used. The content of comonomer is preferably a few mol % (under 4 mol %, for example) per an ethylene unit. Further. polypropylene, polyethylene with high density, polyethylene with intermediate density, linear polyethylene with low density, polyolefin such as ethylene-propylene copolymer and the like can be mixed as desired for use. The content polyolefin other than polyethylene is preferably under 30 w/w %.

The molecule weight of polymer is not particularly specified and is arbitrarily determined according to kinds of resin in view of tensile strength of a sheet, operability at the time of manufacturing or the like. If polyethylene, for example, is used, its weight average molecular weight (Mw: measured by gel permeation chromatography using a calibration curve of standard polystylene; the same hereinafter) is preferably over 100,000 when the sheet is extended in its making process is taken into consideration. It is also preferably under 4,000,000 considering its melt viscosity at the time of making a film. It is more preferably 200,000 to 700,000, furthermore preferably 250,000 to 500,000 of weight average molecular weight. Moreover, weight average molecular weight can be adjusted to a preferable range by such means as blending or multistage polymerization.

Further, the resins described above may contain additives as necessity such as dispersing agent, thixotropy endowment, anti-foam agent, leveling agent, diluents, plasticizing agent, antioxidant, filler, coloring agent and the like, as long as they do not inhibit micro pores from being formed or the like.

A general method such as casting method (T die method) using melted polymer can be utilized as a method for forming film of a stencil sheet using those resins. A sheet may be In the form of sintered resin particles.

Concerning the obtained sheet, a forming method of micro pores is not particularly specified and a general method like a microvoid production method or a solvent extraction method can be used. Specifically, for example, a sheet is treated with heat for fine crystallization. Then, micro crack can be formed in a boundary part between a crystallized area and a non-crystallized area by extending the sheet at least to one axis direction. Further, melted polymer is mixed with a filler when forming a sheet. After a sheet is formed, micro crack can be formed in the part of filler by extending the sheet at least to one axis direction.

Alternatively, after forming a sheet by thermally melting polymer and solvent, the sheet may be cooled off for phase separation from the solvent, and then extended. In this event, the solvent is extracted before or after the extension At this time, inorganic filler may be added for enhancing a property of forming pores by enhancing a dispersion property of the resin.

The micro porous sheet used in the present invention is produced as described above. In addition, a micro porous plastic sheet commercially available such as "Hipore" (trade mark) of Asahi Chemical Industry Co., Ltd., "NF-SHEET" (trade mark, PP type microporous sheet), "PORUM" (trademark, PE type microporous sheet) of Tokuyama Corporation, "SUNMAP" (trade mark, FE fritted sheet), "MICROTEX" (trade mark, tetrafluoroethylene resin sheet) and "BRESULON" (trade mark, PE porous sheet) of Nitto Denko Corporation, "PERMILAN" (trade mark, polyolefin type porous sheet) of Maruzen Polymer Co., Ltd., "S-PORE" (trade mark, polyolefin type porous sheet) of Mitsui Chemicals, Inc and "U-PORE" (trade mark, PE type microporous sheet) of Ube Industries Ltd. can be used.

A micro porous sheet used in the present invention is preferably extended. A plastic sheet has a character that it is extended in a predetermined direction when it is manufactured and that after the extension it tends to shrink in the reverse direction by heating. For that reason, a stencil sheet provided with a property of thermal shrinkage by extending the sheet is used for enhancement of a property of blockage of micro pores, when making a stencil with the heat of a thermal print head.

Further, a thermal treatment process may be performed in in-line or by a separate process in order to adjust the thermal shrink rate of the sheet.

Furthermore, a plastic sheet is preferably containing an anti-static agent in order to prevent poor feeding caused by static electricity. Various surface-active agents can be used as an anti-static agent. Specifically, anionic surface active agents such as salts of fatty acid, salts of higher alcohol sulfuric acid ester, fatty acid amines, fatty acid amidosulfonic acid salts, sulfuric acid salts of fatty acid amide and salts of aliphatic alcohol phosphate ester; cationic surface active agents such as aliphatic amines, quaternary ammonium salts and alkylpyridinium salts; nonionic surface active agents such as polyoxyethylene alkyl ethers, polyoxyethylene alkylphenol ethers, polyoxyethylene alkyl esters and sorbitan alkyl esters; and amphoteric surface active agents such as imidazoline derivatives, higher alkyl amines (betaine type), sulfuric acid ester phosphoric acid ester type and sulfonic acid type are presented. These can be used alone or in combination of more than two kinds.

An anti-static agent may be mixed in the resin before forming to be contained in a film or may be coated on its surface after forming a film. The method for coating is not particularly specified, and such a solvent as water or alcohol, for example, may be used for dilution, After coating by means of spray, impregnation, brushing, a roll coater or the like, the film is dried. Those coatings may be performed in either step of before or after forming micro pores. Although those contents or coating amount is not particularly specified, it can be arbitrarily determined as long as it achieves the object of each additive and it does not inhibit the ink passage.

In addition to that, the surface of the sheet with a releasing agent composed of one or more kinds of silicon type fluorine type, wax type or surface-active agent type, or a releasing agent containing silicon phosphate ester can be used.

A method for coating a releasing agent over a sheet is not particularly specified. For example, components containing anti-sticking material are dispersed or dissolved in an arbitrary solvent, and coated using a roll coater, a gravure coater, a reverse coater, a bar coater or the like and then the solvent is evaporated. The coating may be performed at either step of before or after forming micro pores. Amount of a releasing agent to be applied on the sheet is preferably about 0.001 to 0.5 g/m$^2$ so that ink passage may not be inhibited and excellent releasing property may be obtained.

Making a stencil of the present invention is performed by nipping the sheet during applying pressure with TPH (20) and a platen roller (21) associated with TPH (20) and driving the sheet (10). An anti-sticking layer (12) is provided on the surface of the sheet (10). The anti-sticking layer as described above may adequately contain such agents as anti-static agents described above, thermally melted material or a binder resin, as far as they do not impair the object of the present invention.

Micro pores of a micro porous sheet preferably have an average pore diameter of 0.01 to 1 $\mu$m from the viewpoint of suppressing the amount of ink transfer. When the average pore diameter is smaller than 0.01 $\mu$m, there is a possibility that the ink is prevented from passing through the micro pores, it the passage property of ink tends to become worse and when it is larger than 1 $\mu$m, there is a tendency of becoming unable to control the amount of ink transfer.

Further, gas transmission rate of a micro porous sheet is preferably 1 to 600 seconds. When the gas transmission rate is longer that 600 seconds, there is a possibility that the ink is prevented from passing through the micro pores, and when it is less than 1 second, the sheet does not have enough mechanical strength.

Furthermore, a thickness of the sheet is preferably 1 to 100 $\mu$m. When the thickness is smaller than 1 $\mu$m, the mechanical strength of the film is small, and it is worried that the sheet can not be used as a stencil sheet. When the thickness of the sheet is larger than 100 $\mu$m, there is a possibility that the ink is prevented from passing through the micro pores. In such a case, a uniform quality of picture is not obtained which causes difficulty in obtaining complete uniformity.

In addition to that, surface roughness (Rz: ten points average roughness, JIS B 0601) of the micro porous sheet may be under 20 $\mu$m. When Rz is larger than 20 $\mu$m, inequalities between the print sheet and the stencil sheet become large, so that excessive amount of ink is provided into the gap, which tends to transfer more ink.

Stencil printing using a stencil sheet which is a micro porous sheet, is achieved through the following steps. A stencil plate made face of a stencil sheet is laid over paper, ink is provided from an opposite side (non-stencil plate made face) of the sheet, the ink seeps from non-line area of the stencil plate made face by applying pressure, and the ink is transferred.

It should be noted that in making a stencil described above, micro pores in the non-line area should be pores which do not permit ink to pass through from one side of the sheet to the other side on at least stencil plate made face on which the pores are closed in order to prevent ink from permeating. In other words, pores may remain all over the non-stencil plate made face.

When a sheet which is stencil plate made by the method of the present invention is used in printing, the viscosity of ink to be used is preferably 0.001 to 1 Pa.s, although the passage resistance of ink must be considered. When the viscosity of ink is in this range, permeation of ink into paper is fast, and the amount of ink transfer is limited, resulting in no production of blur or the like.

In order for ink to permeate from a micro porous sheet, surface tension must below. The surface tension is preferably lower than $5\times10^{-2}$ N/m and more preferably lower than $4\times10^{-2}$ N/m.

Considering the pore diameter of the micro porous sheet, if a color agent for ink is a pigment, it may clog the pores. Therefore, dyes are preferable. However, if the pigments are finely dispersible, it may be usable.

Concerning a method for printing, a material having continuous bubbles which is capable of being impregnated with ink is used. The material is, for example, sponge rubber and a synthetic resin form. The material impregnated with ink, is laid over a non-stencil plate made face of a stencil sheet, and then the stencil plate made face is laid over paper. Next, pressure is applied onto them, ink is transferred and then image is formed on print paper.

Alternatively, a material impregnated with ink may be laid over a stencil plate made micro porous sheet, followed by mounting them on an apparatus like PRINT GOKKO (trade mark, RISO Kagaku Co, Ltd.) for press printing.

Alternatively, like In a rotary stencil printing machine, a stencil plate made micro porous sheet is rolled onto the printing drum, and the sheet may be continuously printed by providing ink from the inside of the printing drum.

The present invention will be described hereinafter with reference to the experiments. However, the present invention is not limited by these descriptions.

It should be noted that measurement of physical property and evaluation described in the experiments have been carried out by the following methods:

(1) Melting Point Measurement of a Sheet with DSC (Differential Scanning Calorimeter)

Melting point Tm (° C.) of the stencil plate made micro porous sheet was measured at programming rate of 10° C./min with DSC (DSC 6200, Seiko Instrument Company)

(2) Thermal Shrinking Rate Measurement of the Sheet with TMA (Apparatus for Thermomechanical Analysis)

Thermal shrinking rate of the stencil plate made micro porous sheet was measured with TMA (TMA/SS6100 of Seiko Instrument Company).

The measurement is comprised of the following steps:

A sample was cut off in a size of width of 4 mm, and length of 25 mm, the cut off sample was chucked on TMA to have a length of 15 mm, the thermal shrinkage ratio was measured while the sample was heated from 20° C. at a programming rate of 10° C./min under applying a constant load of $9.8\times10^{-3}$ N, and thermal shrinking of the sheet was measured at its melting point (Tm−30)° C.

The thermal shrinkage ratio of the sheet was taken as an average of the ratio in MD (the feeding direction of the machine) and TD (in the crossing direction with MD).

(3) Heating Peak Temperature of TPH

Heating temperature of TPH was measured by using an infrared radiation thermometer (RM-2A, Nippon Barnes Co,. Ltd.) under each driving condition for TPH (condition of applying voltage). Nothing was in contact with the surface of the heat element.

In this event, the heating temperature was measured by using a band-pass filter. Half value breadth of detection wave length of the filter was 4.9 to 5.4 $\mu$m in a circular view of 7.5 $\mu$s. Infrared emissivity was 1 and sampling period was 7.5 $\mu$s at this band. The center of the circular view was adjusted to the center of the heat element.

The element temperature is highest at the time of termination of applying rectangular pulses in the measurement of peak temperature in rectangular pulses. This element temperature at highest temperature of the element was measured to determine the heating peak temperature of TPH.

(4) Stencil Plate Making

The micro porous sheet was stencil plate made by positive/negative inversion of the original with a stencil plate making Jig. In the stencil plate making jig, an arbitrary TPH can be installed and driving conditions for TPH and the stencil plate making conditions can be set arbitrarily, and then a stencil sheet for stencil printing was stencil plate made by a method in which heated area of the micro pores was closed to yield a non-line area.

(5) Pressure for Stencil Plate Making

Pressure for stencil plate making of stencil plate making jig was measured with a pressure sensor (tactile sensor). A nip area was separately measured. And, the measurement results were converted to per $m^2$ unit to determine the pressure for stencil plate making.

(6) Thermal Shrinkage in Stencil Plate Making

Dimensional variation rate (%) of the sheet before or after stencil plate making with TPH was determined by the following formulae:

((dimension before stencil plate making)−(dimension after stencil plate making))×100/(dimension before stencil plate making)

Validity for use was judged on the following basis concerning the dimension variation rate.

A dimension variation rate under 0.2% means validity for use, and shown by ◎ in Table 1. Under 0.4% means usable, and shown by ○. Under 0.6% means practically usable, and shown by Δ. Over 0.6% means invalid for use, and shown by x.

(7) Property of Pore Blockage

Concerning the micro porous sheet after stencil plate making, degrees of blockage of micro pore area with TPH were observed by SEM, and evaluated on the following basis: When the micro pore area is completely closed, it is shown by ◎ in Table 1. When it is incompletely closed to a very slight degree, it is shown by ○. When it is incompletely closed to a slight degree, it is shown by Δ. When it is incompletely closed to a significant degree, it is shown by (8) Stencil Printing A frame was made on the provided stencil sheet and set in PRINT GOKKO (trade mark, PG-11, RISO Kagaku Co, Ltd.), and continuous bubble sponge (Ruby Cell of Toyo Polymer) impregnated with water-based dye ink which had a surface tension of $3.2\times10^{-2}$ N/m, and a viscosity of $3.2\times10^{-3}$ Pa.s was used as an ink impregnated material to perfom stencil printing.

(9) Pinholes in Non-Line Area

Whether pinholes were produced or not in non-line area of the printed sheet, was visually observed and evaluated on the following basis:

When no pinholes are produced, it is shown by ◎ in Table 1. When very few pinholes are produced, and still the sheet is capable of being used, ○ is presented. When a few pinholes are produced, but still the sheet can be used, it is shown by Δ. When multiple pinholes are produced, and the sheet cannot be used, it is shown by x.

(10) Ratio of Element Sizes to Pitch of Heat Elements for Use

The sizes of the heat elements of the thermal print head for use "in the direction of main scanning A and in the direction of sub-scanning B" were measured by an optical microscope to determine (MRs) and (SPs). (MRs) is the heat element size in the direction of main scanning A, and (SPs) is the heat element size in the direction of sub-scanning.

These measurement results as follows were used to calculate; "the ratio ($MR_S/MR_P$) of the heat element size $MR_S$ in the direction of main scanning to the pitch $MR_P$ in the direction of main scanning of the heat element", and "the ratio ($SR_S/SR_P$) of the heat element size $SR_S$ in the direction of sub-scanning B to the pitch $SR_P$ of the heat element in the direction of sub-scanning B".

EXAMPLE 1

A micro porous sheet was prepared using polyethylene as a base material and a film thickness of 40 μm, an average pore diameter of under 1 μm, pore rate of 60%, gas transmission rate of 120 sec/100 ml and surface roughness (Rz) of 12.221 μm. In this event, a heat treatment at 60° C. was performed in in-line during extension process.

Next, the above micro porous sheet was coated with a solution of a releasing agent containing 1.0 part by weight of dimeticone copolyolphosphate ester (Pecosil PS-200, Phoenix Chemical Incorporated) and 99.0 parts by weight of isopropyl alcohol with a wirebar, dried and then an anti-sticking layer of 0.05 g/m$^2$ was obtained.

The thermo physical property of the obtained microporous sheet was that the melting point (Tm) was 131 (° C.), and the thermal shrinking rate of TMA at Tm-30° C. was 4.2% as shown in Table 1.

Further, the obtained micro porous sheet was stencil plate made and printed. As shown Table 1, all the results concerning on thermal shrinkage, pore blockage, and pinholes obtained by the stencil plate making were quite favorable under the conditions of current-carrying time period of 5000 μs and of TPH current-carrying cycle of 10000 μs using TPH having resolution and a element size shown in Table 1.

EXAMPLE 2

A micro porous sheet was stencil plate made and printed as in Example 1 except that current-carrying time period of 7500 μs and current-carrying cycle of 30000 μs were used for TPH.

As shown in Table 1, all the results concerning on thermal shrinkage, pore blockage, and pin holes obtained by the stencil plate making were quite favorable

EXAMPLE 3

A micro porous sheet was stencil plate made and printed as in Example 1 except that current-carrying time period of 6000 μs and current-carrying cycle of 10000 μs were used for TPH.

As shown in Table 1, the thermal shrinkage by the stencil plate making was satisfactory, and the results concerning on pore blockage and pinholes were quite favorable.

EXAMPLE 4

A micro porous sheet was stencil plate made and printed as in Example 1 except that current-carrying time period of 6000 μs and current-carrying cycle of 30000 μs were used for TPH.

As shown in Table 1, the thermal shrinkage by the stencil plate making was quite satisfactory, and the results concerning on pore blockage and pinholes were favorable.

EXAMPLE 5

A micro porous sheet was stencil plate made and printed as in Example 1 except that current-carrying time period of 8000 μs and current-carrying cycle of 10000 μs were used for TPH.

As shown in Table 1, although a bit of thermal shrinkage by stencil plate making was produced, it was still usable. The results concerning on pore blockage and pinholes were quite favorable.

EXAMPLE 6

A micro porous sheet was stencil plate made and printed as in Example 1 except that current-carrying time period of 3000 μs and current-carrying cycle of 30000 μs were used for TPH.

As shown in Table 1, the thermal shrinkage by stencil plate making was very satisfactory. The results concerning on pore blockage and pinholes showed that they were practically usable.

EXAMPLE 7

Stencil plate making and printing were performed under the same conditions as in Example 6 except that the pressure for stencil plate making in Example 6 was changed to 0.15 MPa As shown in Table 1. although the thermal shrinkage by stencil plate making was slightly produced, it was usable. The results concerning on pore blockage and pinholes showed that they were practically usable.

EXAMPLE 8

Stencil plate making and printing were performed under the same conditions as in Example 5 except that the pressure for stencil plate making in Example 5 was changed to 0.95 MPa.

As shown in Table 1, although the thermal shrinkage by stencil plate making was partially produced to some extent, it was usable. The results concerning on pore blockage and pinholes were quite favorable.

EXAMPLE 9

The micro porous sheet used in Example 6 was framed and left in an oven at 70° C. for one hour The result showed that the thermal shrinking rate $S_{Tm-30}$ decreased to 1.3%. After that, the obtained micro porous sheet was stencil plate made and printed under the same conditions as in Example 6. The results were shown in Table 1.

As shown in Table 1, the thermal shrinkage by stencil plate making was quite satisfactory and the results concerning on pore blockage and pinholes showed that they were practically usable.

EXAMPLE 10

A micro porous sheet was prepared using polyethylene as a base material and a film thickness of 41 μm, an average pore diameter of under 1 μm, pore rate of 70%, gas transmission rate of 105 sec/100 ml and surface roughness (Rz) of 13.312 μm. In this instance, a heat treatment at 60° C. was performed in in-line during extension process. Further, an anti-sticking layer was placed on the obtained micro porous sheet as in Example 1. The thermo physical property of the obtained micro porous sheet was that the melting point (Tm) was 130.2° C., and the thermal shrinking of TMA at Tm−30° C. was 19.5% as shown in Table 1.

The obtained micro porous sheet was stencil plate made and printed under the same conditions as in Example 5.

As shown in Table 1, although the thermal shrinkage by stencil plate making was slightly produced, it was usable. The results concerning on pore blockage and pinholes were very favorable.

EXAMPLE 11

Stencil plate making and printing were performed under the same conditions in Example 6 except for changing resolution and element size of TPH as shown in Table 1.

It should be noted that applying voltage for TPH was adjusted so as to make the heating peak temperature equal to that in Example 6.

As shown in Table 1, the thermal shrinkage by stencil, pore blockage and pinholes were quite excellent and the results were much better than those in Example 6.

The reason for the better result was that "element size/pitch ratio" was larger than that in Example 6, which resulted in decrease in temperature difference between high and low in the heating temperature distribution of TPH, making the temperature distribution more uniform.

EXAMPLE 12

Stencil plate making and printing were performed under the same conditions in Example 5 except for changing resolution and element size of TPH as shown in Table 1.

It should be noted that applying voltage for TPH was adjusted so as to make the heating peak temperature equal to that in Example 5.

As shown in Table 1, the thermal shrinkage by stencil plate making was satisfactory. The results concerning on pore blockage and pinholes were very favorable.

"Element size/pitch ratio" was larger than that in Example 5. temperature difference between high and low decreased in the heating temperature distribution made the temperature distribution more uniform. No problem was raised for use.

COMPARATIVE EXAMPLE 1

The micro porous sheet used in Example 1 was stencil made and printed as in Example 1 except that current-carrying time period of 9000 μs and current-carrying cycle of 10000 μs were applied for TPH.

As shown in Table 2, although the pore blockage and pinholes were quite excellent, the thermal shrinkage by stencil making was so large that the sheet was unusable.

COMPARATIVE EXAMPLE 2

The micro porous sheet used in Example 1 was stencil made and printed as in Example 1 except that current-carrying time period of 2000 μs and current-carrying cycle of 30000 μs were employed for TPH.

As shown in Table 2, although the thermal shrinkage by stencil making was quite excellent, pore blockage was not enough and a number of pinholes were produced, which led to a result that this sheet was unusable.

COMPARATIVE EXAMPLE 3

Stencil plate making and printing were performed under the same conditions as in Example 6 except for changing the pressure for stencil plate making in Example 6 to 0.05 MPa.

As shown in Table 2, the thermal shrinkage by stencil making was large. Further, pore blockage was not enough and a number of pinholes were produced, which led to a result that this sheet was unusable.

COMPARATIVE EXAMPLE 4

Stencil plate making and printing were performed under the same conditions as in Example 5 except for changing the pressure for stencil making in Example 5, to 1.05 MPa.

As shown in Table 2, although the pore blockage and the pinholes were quite excellent, thermal shrinkage by stencil making was partially produced too a large extent, which led to a result that this sheet was unusable.

COMPARATIVE EXAMPLE 5

The micro porous sheet used in the Example 6 was framed and left in the 80° C. oven for one hour. The result showed that the thermal shrinking rate $S_{Tm\text{-}30}$ decreased to 0.8%. After that, the provided micro porous sheet was stencil made and printed under the same conditions as in the Example 6.

As shown in Table 2, the thermal shrinkage was quite excellent. However, multiple pore blockage and pinholes were produced, which led to a result that they were unusable.

COMPARATIVE EXAMPLE 6

A micro porous sheet was prepared using polyethylene as a base material and film thickness of 42 μm, an average pore diameter of under 1 μm, pore rate of 75%, gas transmission rate of 102 sec/100 ml and surface roughness (Rz) of 13.846 μm. At this time, a heat treatment at 50° C. was performed in in-line. Further, the obtained micro porous sheet was provided of an anti-sticking layer as that in Example 1. The thermo physical property of the micro porous sheet obtained in this manner was that a melting point (Tm) was 130.5° C. and the thermal shrinking of TMA at Tm−30° C. was 21.3%. The obtained micro porous sheet was stencil plate made and printed under the same conditions as In Example 5.

As shown in Table 2. pore blockage and pinholes were very favorable. However, partially large thermal shrinkage was produced by stencil making, which led to a result that this sheet was unusable.

TABLE 1

| | | Example | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Film Thickness | (μm) | 40 | 40 | 40 | 40 | 40 | 40 | 40 | 40 | 40 | 41 | 40 | 40 |
| Average pore diameter | (μm) | 1≧ | 1≧ | 1≧ | 1≧ | 1≧ | 1≧ | 1≧ | 1≧ | 1≧ | 1≧ | 1≧ | 1≧ |
| Pore rate | (%) | 60.0 | 60.0 | 60.0 | 60.0 | 60.0 | 60.0 | 60.0 | 60.0 | 60.0 | 70.0 | 60.0 | 60.0 |
| Gas transmission rate | (sec/100 cc) | 120 | 120 | 120 | 120 | 120 | 120 | 120 | 120 | 120 | 105 | 120 | 120 |
| Surface roughness (Rz) | ($\mu m^2$) | 12.221 | 12.221 | 12.221 | 12.221 | 12.221 | 12.221 | 12.221 | 12.221 | 12.221 | 13.312 | 12.221 | 12.221 |
| Melting Point (Tm) | (° C.) | 131.0 | 131.0 | 131.0 | 131.0 | 131.0 | 131.0 | 131.0 | 131.0 | 131.0 | 130.2 | 131.0 | 131.0 |
| Thermal Shrinking rate of sheet $S_{Tm-30}$ | (%) | 4.2 | 4.2 | 4.2 | 4.2 | 4.2 | 4.2 | 4.2 | 4.2 | 1.3 | 19.5 | 4.2 | 4.2 |
| Current carrying time period To | (μs) | 5000 | 7500 | 6000 | 6000 | 8000 | 3000 | 3000 | 8000 | 3000 | 8000 | 3000 | 8000 |
| Current carrying cycle Ts | (μs) | 10000 | 30000 | 10000 | 30000 | 10000 | 30000 | 30000 | 10000 | 30000 | 10000 | 30000 | 10000 |
| To × 100/Ts | (%) | 50 | 25 | 60 | 20 | 80 | 10 | 10 | 80 | 10 | 80 | 10 | 80 |
| TPH heat peak temperature TP | (° C) | 328.3 | 132.4 | 378.6 | 114.5 | 427.5 | 103.2 | 103.2 | 427.5 | 103.2 | 427.5 | 103.2 | 427.5 |

TABLE 1-continued

| | | Example | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| $T_p - T_m$ | (° C.) | 197.3 | 1.4 | 247.6 | −16.5 | 296.5 | −27.8 | −27.8 | 296.5 | −27.8 | 297.3 | −27.8 | 296.5 |
| Pressure for stencil plate making | ($MP_4$) | 0.30 | 0.30 | 0.30 | 0.30 | 0.30 | 0.30 | 0.15 | 0.95 | 0.30 | 0.30 | 0.30 | 0.30 |
| Element size in the main scanning direction MRs | (μm) | 35 | 35 | 35 | 35 | 35 | 35 | 35 | 35 | 35 | 35 | 74 | 74 |
| Pitch of heat element in the main scanning direction MRp | (μm) | 84.7 | 84.7 | 84.7 | 84.7 | 84.7 | 84.7 | 84.7 | 84.7 | 84.7 | 84.7 | 84.7 | 84.7 |
| (MRs/MRp) × 100 | (%) | 41.3 | 41.3 | 41.3 | 41.3 | 41.3 | 41.3 | 41.3 | 41.3 | 41.3 | 41.3 | 87.4 | 87.4 |
| Element size in the sub scanning direction SRs | (μm) | 35 | 35 | 35 | 35 | 35 | 35 | 35 | 35 | 35 | 35 | 55 | 55 |
| Pitch of heat element in the sub scanning direction SRp | (μm) | 84.7 | 84.7 | 84.7 | 84.7 | 84.7 | 84.7 | 84.7 | 84.7 | 84.7 | 84.7 | 10.6 | 10.0 |
| (SRs/SRp) × 100 | (%) | 41.3 | 41.3 | 41.3 | 41.3 | 41.3 | 41.3 | 41.3 | 41.3 | 41.3 | 41.3 | 517.5 | 517.5 |
| Thermal shrinkage by stencil plate making | | ◎ | ◎ | ○ | ◎ | Δ | ◎ | Δ | Δ | ◎ | Δ | ◎ | ○ |
| Pore blockage | | ◎ | ◎ | ◎ | ○ | ◎ | Δ | Δ | ◎ | Δ | ◎ | ◎ | ◎ |
| Pinhole | | ◎ | ◎ | ◎ | ○ | ◎ | Δ | Δ | ◎ | Δ | ◎ | ◎ | ◎ |

TABLE 2

| | | Comparative Example | | | | | |
|---|---|---|---|---|---|---|---|
| | | 1 | 2 | 3 | 4 | 5 | 6 |
| Film thickness | (μm) | 40 | 40 | 40 | 40 | 40 | 42 |
| Average pore diameter | (μm) | 1≧ | 1≧ | 1≧ | 1≧ | 1≧ | 1≧ |
| Pore rate | (%) | 60.0 | 60.0 | 60.0 | 60.0 | 60.0 | 75.0 |
| Gas transmission rate | (sec/100 cc) | 120 | 120 | 120 | 120 | 120 | 102 |
| Surface roughness (Rz) | ($\mu m^2$) | 12,221 | 12,221 | 12,221 | 12,221 | 12,221 | 13,864 |
| Melting point (Tm) | (° C.) | 131.0 | 131.0 | 131.0 | 131.0 | 131.0 | 130.5 |
| Thermal Shrinking rate of sheet $S_{Tm-30}$ | (%) | 4.2 | 4.2 | 4.2 | 4.2 | 0.8 | 21.3 |
| Current-carrying time period To | (μs) | 9000 | 2000 | 3000 | 8000 | 3000 | 8000 |
| Current-carrying cycle Ts | (μs) | 10000 | 30000 | 30000 | 10000 | 30000 | 10000 |
| To × 100/Ts | (%) | 90 | 7 | 10 | 80 | 10 | 80 |
| TPH heal peak temperature Tp | (° C.) | 440.6 | 95.6 | 103.2 | 427.5 | 103.2 | 427.5 |
| Tp − Tm | (° C.) | 309.6 | −35.4 | −27.8 | 296.5 | −27.8 | 297.0 |
| Pressure for stencil plate making | ($MP_6$) | 0.30 | 0.30 | 0.05 | 1.05 | 0.30 | 0.30 |
| Element size in the main scanning direction MRs | (μm) | 35 | 35 | 35 | 35 | 35 | 35 |
| Pitch of heal element in the main scanning direction MRp | (μm) | 84.7 | 84.7 | 84.7 | 84.7 | 84.7 | 84.7 |
| (MRs/MRp) × 100 | (%) | 41.3 | 41.3 | 41.3 | 41.3 | 41.3 | 41.3 |
| Element size in the sub-scanning direction SRs | (μm) | 35 | 35 | 35 | 35 | 35 | 35 |
| Pitch of heal element in the sub scanning direction SRp | (μm) | 84.7 | 84.7 | 84.7 | 84.7 | 84.7 | 84.7 |
| (SRs/SRp) × 100 | (%) | 41.3 | 41.3 | 41.3 | 41.3 | 41.3 | 41.3 |
| Thermal shrinkage by stencil plate making | | x | ◎ | x | x | ◎ | x |
| Pore blockage | | ◎ | x | x | ◎ | x | ◎ |
| Pinhole | | ◎ | x | x | ◎ | x | ◎ |

It should be understood that the foregoing relates to only a preferred embodiment of the invention, and it is intended to cover all changes and modifications of the examples of the invention herein chosen for the purposes of the disclosure, which do not constitute departures from the sprit and scope of the invention.

What is claimed is:

1. A method for stencil plate making of a stencil sheet for stencil printing performed for a micro porous plastic sheet, comprising the steps of:

providing required heat for melting a surface or inside of the plastic sheet to a form of negative image by heating means of a thermal head (TPH);

thermally shrinking or heat melting micro pores in the heated area of said micro porous plastic sheet; and pressing the micro pores of the sheet for blockage wherein the following formula (1) and (2) concerning driving conditions for said thermal head;

the following formula (3) concerning pressure for stencil making for pressing the micro pores; and the following formula (4) concerning thermal shrinking rate of said sheet are satisfied simultaneously, $$-30 \leqq Tp - Tm \leqq 300 \text{ (° C.)} \quad (1)$$

(wherein, Tp represents heating peak temperature, and Tm represents a melting temperature (melting point) of the sheet)

$$10 \leqq To \times 100/Ts \leqq 80\ (\%) \quad (2)$$

(wherein, To represents current-carrying time period, Ts represents current-carrying cycle, To×100/Ts represents the ratio of To to Ts)

$$0.1 \leqq p \leqq 1.0\ (\text{MPa}) \quad (3)$$

(wherein, P represents pressure for stencil plate making)

$$1 \leqq S_{Tm-30} \leqq 20\ (\%) \quad (4)$$

(wherein, $S_{Tm-30}$ represents the thermal shrinkage rate at a temperature 30° C. lower than that of the melting point of the sheet Tm in TMA (thermal mechanical analysis).

2. The method for stencil plate making of stencil sheet for stencil printing according to claim 1, wherein said formula (1) further is;

$$-20 \leqq Tp < Tm \leqq 250\ (^\circ\ \text{C.}) \quad (1)$$

said formula (2) is;

$$20 \leqq To \times 100/Ts \leqq 60\ (\%) \quad (2)$$

said formula (3) is;

$$0.2 \leqq P \leqq 0.9\ (\text{MPa}) \quad (3)$$

and
said formula (4) is;

$$3 \leqq S_{Tm-30} \leqq 15\ (\%) \quad (4).$$

3. The method for stencil plate making for a stencil sheet for stencil printing according to claim 1, wherein said formula (1) is being;

$$0 \leqq Tp - Tm \leqq 200\ (^\circ\ \text{C.}) \quad (1)$$

said formula (2) is;

$$25 \leqq To \times 100/Ts \leqq 50\ (\%) \quad (2)$$

said formula (3) is;

$$0.3 \leqq P \leqq 0.8\ (\text{MPa}) \quad (3)$$

and
said formula (4) is;

$$4 \leqq S_{Tm-30} \leqq 10\ (\%) \quad (4).$$

4. The method for stencil plate making for a stencil sheet for stencil printing according to claim 1, wherein:

a ratio of a size of a heat generating element to a pitch of the heat generating element in the direction of a main scanning of said thermal head is a ratio satisfying with the following formula (5) and a ratio of a size of the heat generating element to a pitch of the heat generating element in the direction of sub scanning of said thermal head, is a ratio satisfying with the following formula (6)

$$42 \leqq MR_S/MR_P \leqq 88\ (\%) \quad (5)$$

$$42 \leqq SR_S/SR_P \leqq 519\ (\%) \quad (6)$$

(wherein, $MR_S$ is a size of a heat element in the direction of main scanning, and $MR_P$ is a pitch of a heat element in the direction of main scanning of the thermal print head, $SR_S$ is a size of a heat element in the direction of sub-scanning, and $SR_P$ is a pitch of a heat element in the direction of sub-scanning of the thermal print head).

* * * * *

UNITED STATES PATENT AND TRADEMARK OFFICE

CERTIFICATE OF CORRECTION

PATENT NO. : 6,550,380 B2
DATED : April 22, 2003
INVENTOR(S) : Kinoshita et al.

It is certified that error appears in the above-identified patent and that said Letters Patent is hereby corrected as shown below:

Column 19,
Line 16, change "30°C." to -- 30°C --.
Line 21, (Eqn.1) change "$T_p \prec T_m$" to -- $T_p$-$T_m$ --.
Line 38, (Eqn.1) change "(°C.)" to -- (°C) --.

Column 20,
Line 20, after "(5)", insert -- ; --.

Signed and Sealed this

Twelfth Day of August, 2003

JAMES E. ROGAN
*Director of the United States Patent and Trademark Office*